US008443614B2

(12) United States Patent
Kim

(10) Patent No.: US 8,443,614 B2
(45) Date of Patent: May 21, 2013

(54) REFRIGERATOR AND METHOD FOR CONTROLLING THE SAME

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 832 days.

(21) Appl. No.: 12/634,474

(22) Filed: Dec. 9, 2009

(65) Prior Publication Data

US 2010/0175783 A1 Jul. 15, 2010

Related U.S. Application Data

(60) Provisional application No. 61/145,025, filed on Jan. 15, 2009.

(51) Int. Cl.
*F25D 23/00* (2006.01)
*B65B 1/30* (2006.01)

(52) U.S. Cl.
USPC ..... 62/3.64; 62/389; 141/95; 141/98; 141/370

(58) Field of Classification Search
USPC ..... 141/1, 82, 94–95, 98, 369–371; 62/3.63–3.64, 389
See application file for complete search history.

(56) References Cited

U.S. PATENT DOCUMENTS 4,883,100 A * 11/1989 Stembridge et al. ..... 141/1
4,890,651 A * 1/1990 Stembridge et al. ..... 141/1
4,911,212 A * 3/1990 Burton ..... 141/369
4,917,155 A * 4/1990 Koblasz et al. ..... 141/1
4,961,456 A * 10/1990 Stembridge et al. ..... 141/1
RE33,435 E * 11/1990 Koblasz et al. ..... 141/1
5,036,892 A * 8/1991 Stembridge et al. ..... 141/1
5,526,854 A * 6/1996 Unger ..... 141/351
5,566,732 A * 10/1996 Nelson ..... 141/94
5,603,363 A * 2/1997 Nelson ..... 141/351
6,082,419 A * 7/2000 Skell et al. ..... 141/198
6,227,265 B1 * 5/2001 Skell et al. ..... 141/198
6,425,425 B2 * 7/2002 Bianchi et al. ..... 141/362
6,688,134 B2 * 2/2004 Barton et al. ..... 62/390
6,705,356 B2 * 3/2004 Barton et al. ..... 141/2
7,188,479 B2 * 3/2007 Anselmino et al. ..... 62/66
7,219,509 B2 * 5/2007 Pastryk et al. ..... 62/344
7,266,972 B2 * 9/2007 Anselmino et al. ..... 62/344
7,455,085 B2 * 11/2008 Voglewede et al. ..... 141/360
7,661,448 B2 * 2/2010 Kim et al. ..... 141/94
7,673,661 B2 * 3/2010 Chase et al. ..... 141/360
7,690,403 B2 * 4/2010 You et al. ..... 141/83
7,743,801 B2 * 6/2010 Janardhanam et al. ..... 141/351
7,810,345 B2 * 10/2010 Nebbia et al. ..... 62/338
7,921,668 B2 * 4/2011 Lee et al. ..... 62/389
8,069,883 B2 * 12/2011 Shiraishi ..... 141/94
8,109,301 B1 * 2/2012 Denise ..... 141/360
8,162,011 B2 * 4/2012 Weems ..... 141/95
8,167,004 B2 * 5/2012 Lee et al. ..... 141/198
8,196,618 B2 * 6/2012 Kim et al. ..... 141/82
8,245,735 B2 * 8/2012 Chase et al. ..... 141/1
8,322,384 B2 * 12/2012 Ashrafzadeh et al. ..... 141/198
8,327,889 B2 * 12/2012 Ashrafzadeh et al. ..... 141/94

(Continued)

*Primary Examiner* — Gregory Huson
*Assistant Examiner* — Nicolas A Arnett
(74) *Attorney, Agent, or Firm* — Birch, Stewart, Kolasch & Birch, LLP

(57) ABSTRACT

Provided is a refrigerator with a dispenser assembly capable of sensing the height of a vessel and water level using a remote sensor by employing changes in electrostatic capacitance, in order to enable a user to automatically dispense water to a desired level regardless of the material or size of a vessel.

19 Claims, 7 Drawing Sheets

U.S. PATENT DOCUMENTS

| | | | | |
|---|---|---|---|---|
| 8,328,054 | B2 * | 12/2012 | Oh | 222/504 |
| 2005/0178273 | A1 * | 8/2005 | Meuleners et al. | 99/279 |
| 2006/0086129 | A1 * | 4/2006 | Anselmino et al. | 62/344 |
| 2007/0272019 | A1 * | 11/2007 | Agam et al. | 73/628 |
| 2008/0105331 | A1 * | 5/2008 | You et al. | 141/198 |
| 2008/0168791 | A1 * | 7/2008 | Nebbia et al. | 62/389 |
| 2008/0190514 | A1 * | 8/2008 | Lee et al. | 141/95 |
| 2009/0183796 | A1 * | 7/2009 | Chase et al. | 141/1 |
| 2010/0175412 | A1 * | 7/2010 | Kim | 62/320 |
| 2012/0031523 | A1 * | 2/2012 | Bertoni et al. | 141/1 |

* cited by examiner

REFRIGERATOR AND METHOD FOR CONTROLLING THE SAME

This Non-Provisional application claims priority under 35 U.S.C. 119(e) on U.S. Provisional Application No. 61/145,025, filed on Jan. 15, 2009, which is hereby incorporated by reference in its entirety.

THE BACKGROUND

1. The Field

The present invention relates to a refrigerator and a method for controlling a refrigerator.

2. Description of the Related Art

In general, a refrigerator is a household appliance for storing food at low temperatures over extended periods.

Specifically, depending on the locations of their refrigeration compartments and freezer compartments, refrigerators can be categorized into top mount refrigerators having the freezer compartment provided at the top, bottom freezer refrigerators having the freezer compartment provided at the bottom, and side by side refrigerators having the refrigeration compartment and freezer compartment arranged to the left and right of each other.

Also, a plurality of shelves on which food is placed, and box-shaped drawers open at the top for storing vegetables or fruit may be provided inside a refrigerator. Also, an ice maker may be installed within the freezer compartment or the refrigeration compartment, or on the rear of a door. In addition, depending on the product, a dispenser may be provided at the front of a refrigerator door to dispense water or ice, and a home bar structure may be provided on a refrigerator door to enable storing and removal of beverages or vessels filled with water without having to open a door of the refrigerator.

THE DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

While a bottom freezer refrigerator is exemplarily used below to describe the present invention, the present invention is not limited thereto, and can also be applied to a side by side refrigerator and a top mount refrigerator.

Figure 1:
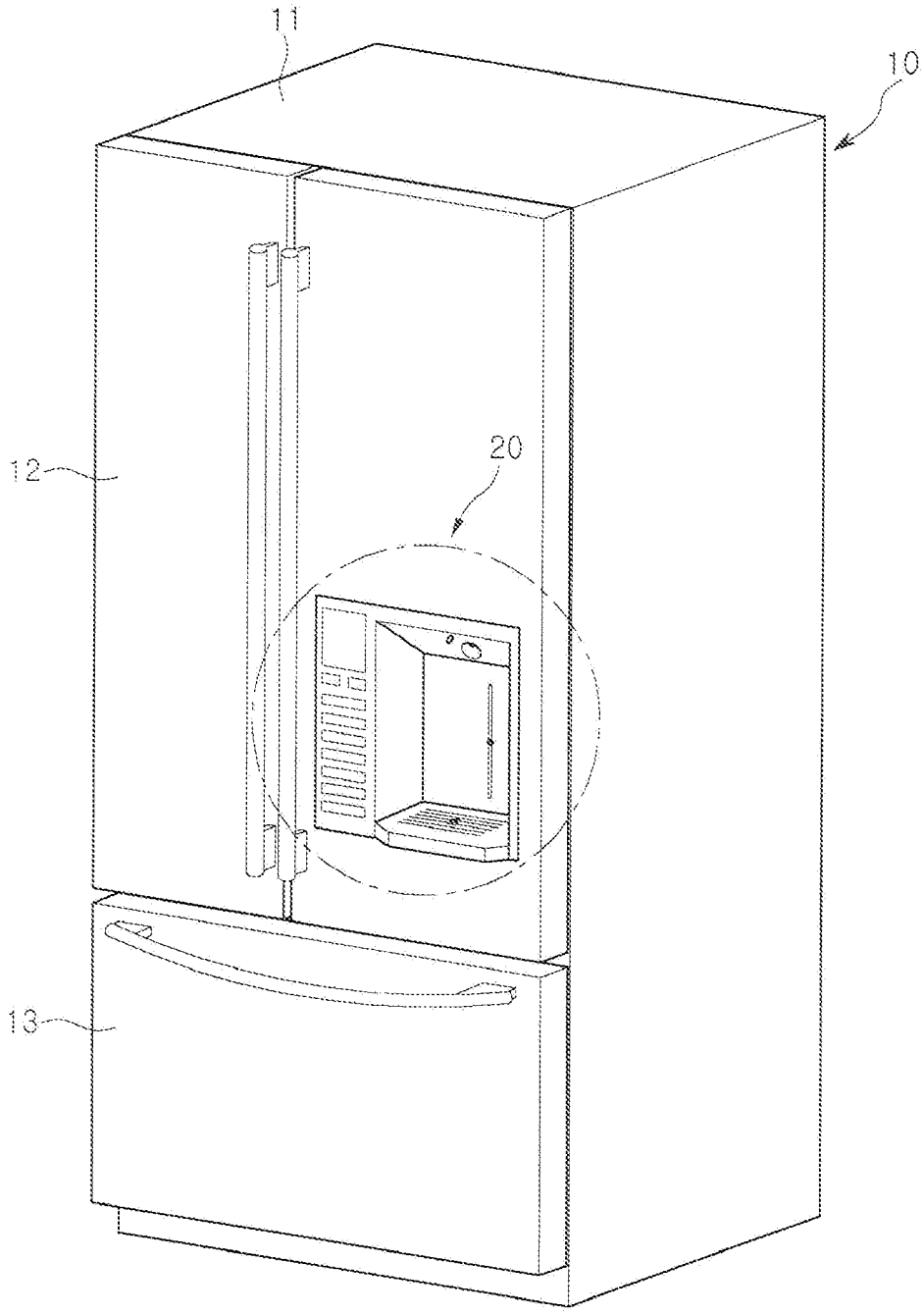
FIG. 1 is an external perspective view of a refrigerator provided with a vessel height and water level sensing apparatus according to embodiments of the present invention.
Figure 2:
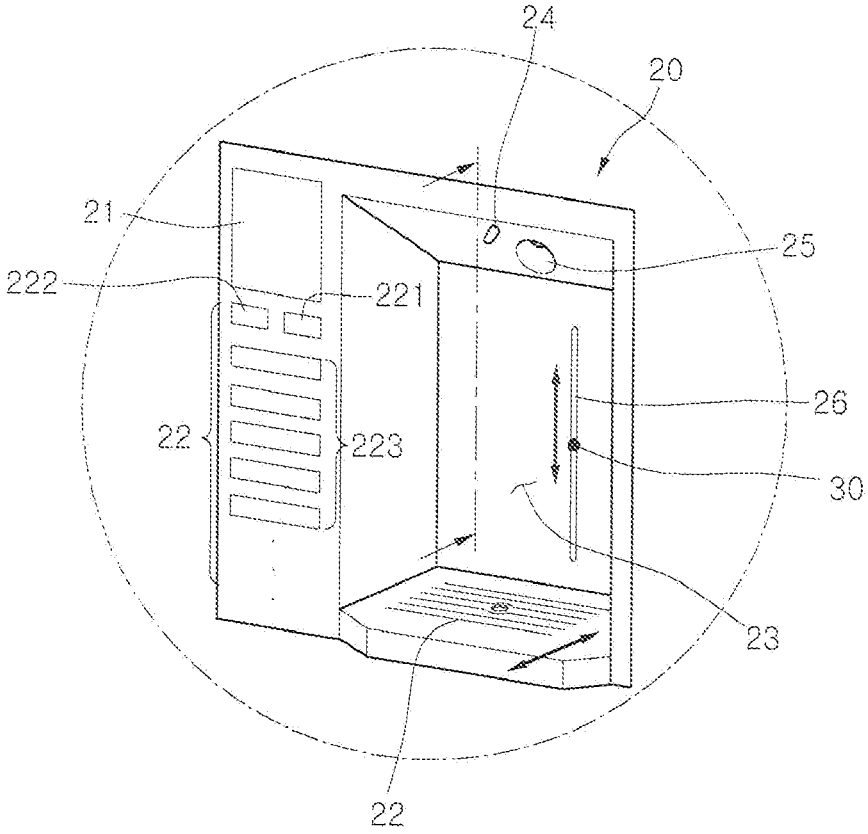
FIG. 2 is an enlarged perspective view of a dispenser assembly in region A in FIG. 1.

FIG. 1 is an external perspective view of a refrigerator provided with a vessel height and water level sensing apparatus according to embodiments of the present invention, and FIG. 2 is an enlarged perspective view of a dispenser assembly in region A in FIG. 1.

Referring to FIGS. 1 and 2, a refrigerator 10 according to embodiments of the present invention includes a body 11 provided with a refrigeration compartment and a freezer compartment within, a refrigeration compartment door 12 opening and closing the refrigeration compartment, a freezer compartment door 13 opening and closing the freezer compartment, and a dispenser assembly 20 provided on the front surface of the refrigeration compartment door 12 to enable dispensing of ice and/or water without having to open the door. Here, the dispenser assembly 20 may be mounted on the freezer compartment door instead of on the refrigeration compartment door.

In detail, a sensor 30 is mounted on the dispenser assembly 20 to sense the height of a vessel and sense the level of water supplied to a vessel. Also, a vessel receiving portion 23 is defined recessed rearward in the dispenser assembly 20 to receive a vessel such as a cup. Further, a water dispensing hole 24 and an ice dispensing hole 25 are respectively provided on an upper surface of the vessel receiving portion 23. A tray 22 for supporting a vessel is provided on the floor of the vessel receiving portion 23. The tray 22 may be provided to be withdrawn forward and inserted rearward according to the size of a vessel. While the water dispensing hole 23 is depicted in the drawings as a fixed structure, it may be configured to be withdrawn forward according to the size of a vessel. For example, the water dispensing hole 24 may be modularized and inserted in the door 12, and may be withdrawn forward when the front portion thereof is pressed and released. As a simple example, it may employ the same principle as an optical disk tray installed in a desktop computer case. Also, the module may be configured to be rotatable, whereupon rotation thereof in one direction withdraws the water dispensing hole 24 forward, and rotation in the opposite direction or further rotation in the one direction inserts the water dispensing hole 24 rearward.

Furthermore, the dispenser assembly 20 may be provided on one side edge thereof (the left side in the drawings) with a display 21 that displays data including the operating state of the refrigerator or the operating state of the dispenser assembly 20, and an input portion 22 for inputting specific commands. In detail, the input portion 22 includes a water dispensing button 221 for inputting a command to dispense water, an ice dispensing button 222 for dispensing ice, and a water level input button 223 for inputting a level of water to be supplied. The buttons may be separately provided below the display 21 or may be configured in touch-screen format on the display 21.

Additionally, a slot 26 is defined vertically in the rear surface of the vessel receiving portion 23 to enable the sensor 30 to be moved upward and downward.

Figure 3:
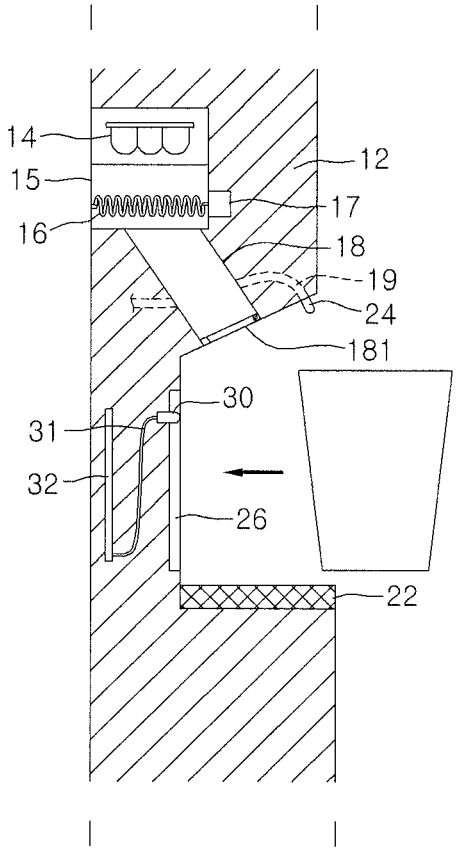
FIG. 3 is a side sectional view showing the inner structure of a refrigerator door provided with a dispenser assembly according to embodiments of the present invention.

FIG. 3 is a side sectional view showing the inner structure of a refrigerator door provided with a dispenser assembly according to embodiments of the present invention.

Referring to FIG. 3, a sensing member for sensing the height of a vessel and the level of water filled in a vessel may be provided on a dispenser assembly 20 of a refrigerator according to embodiments of the present invention. The sensing member includes a sensor 30 that senses the height of a vessel and water level, and a drive unit that drives the sensor.

Specifically, an ice maker 14 for making ice, and an ice bin 15 (for storing ice that is made by the ice maker 14 and descends) are mounted on the rear of a refrigerator door of a refrigerator provided with the dispenser assembly 20. Also, a conveyor 16 that conveys ice to a dispensing hole is provided within the ice bin 15, and a conveyor motor 17 is provided at one side of the ice bin 15 to drive the conveyor 16.

Also, a discharge duct 18 is defined within the refrigeration compartment door 12 to discharge ice stored in the ice bin 15 to the outside. The discharge duct 18 connects one side of the ice bin 15 to the ice dispensing hole 15. Also, a damper 181 is provided within the discharge duct 18 or at the ice dispensing hole 25 to selectively open and close the discharge duct 18. In other words, when a user inputs an ice dispensing command, the damper 181 rotates to open the discharge duct 18, and at other times, the discharge duct 18 is kept closed by the damper 181. Also, a water hose 19 for supplying water extends to the water dispensing hole 24 inside the refrigeration compartment door 12.

The sensor 30 is movably provided within the refrigeration compartment door 12 at the rear of the vessel receiving portion 23, and a wire 31 and a printed circuit board (PCB) 32 are built in to transmit signals sensed by the sensor 30 to a main controller of the refrigerator. The wire 31 may be of a sufficient extending length so that is does not separate from the PCB 32 when the sensor 30 is moved. Also, a space must be provided inside the door 12 enabling free bending of the wire 31 received therein.

A detailed description will be provided below on the structure and operation of a drive unit that enables upward and downward movement of the sensor 30, with reference to the drawings.

Figure 4:
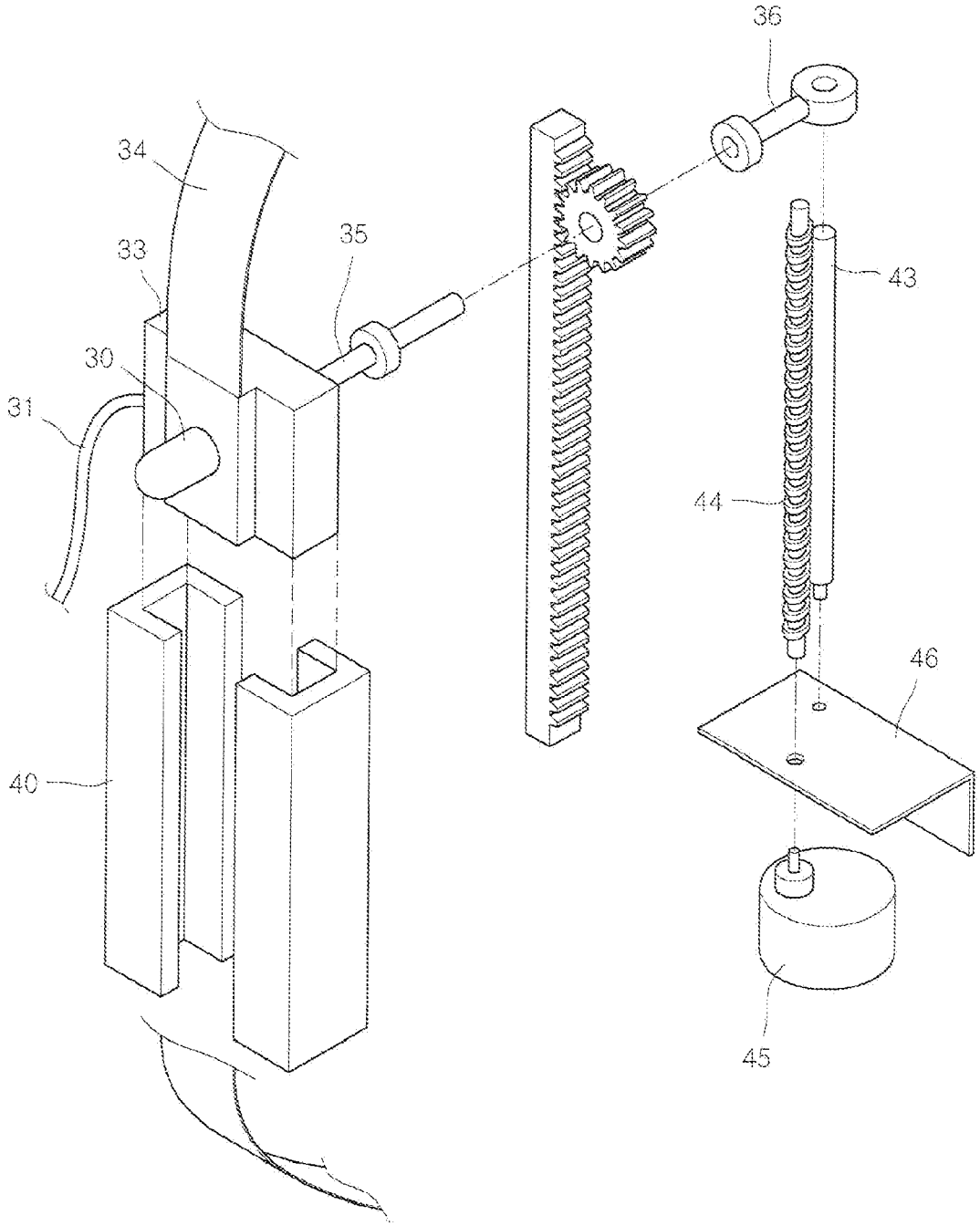
FIG. 4 is an exploded perspective view showing the structure of a sensor drive unit according to embodiments of the present invention.
Figure 5:
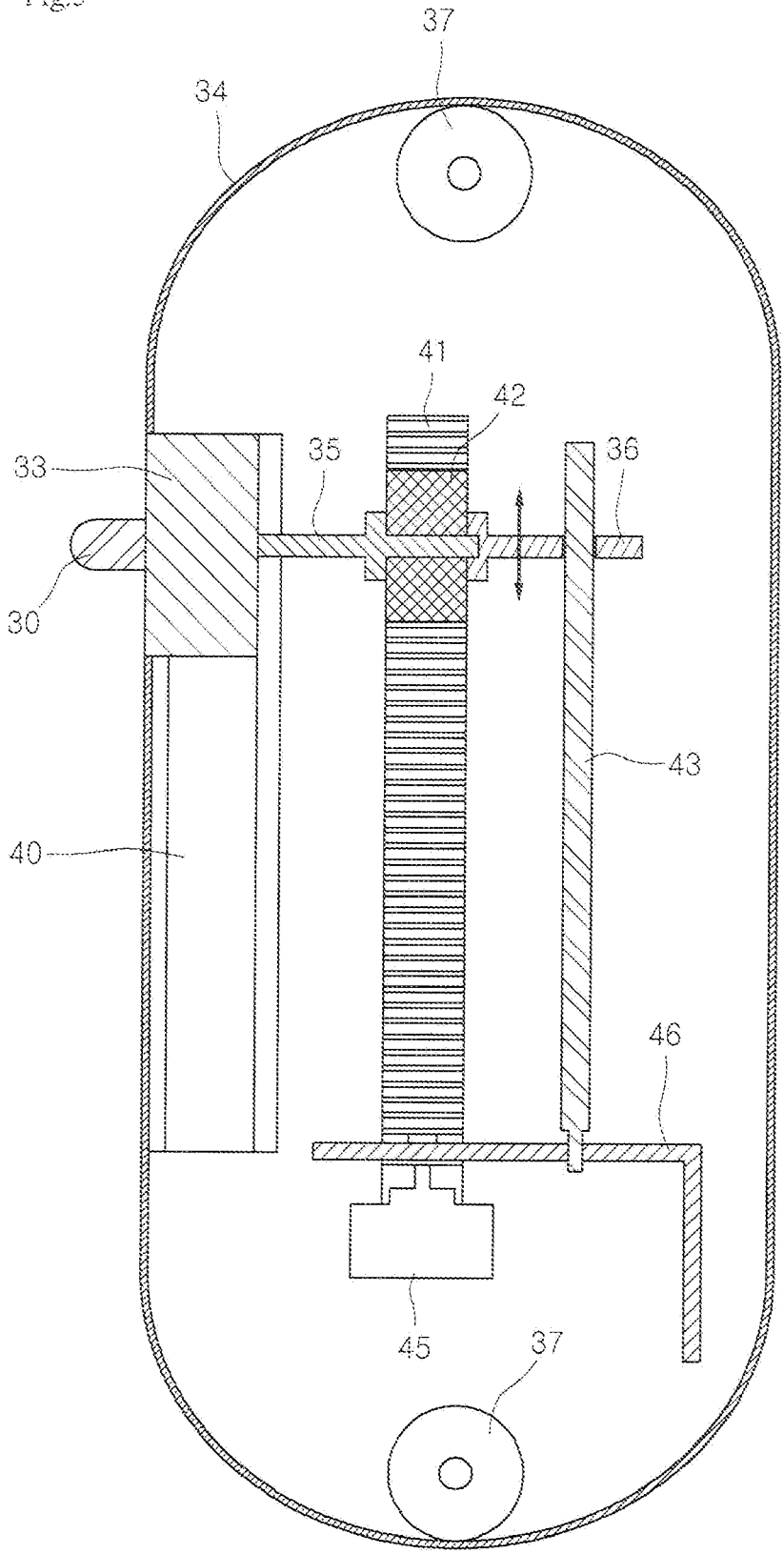
FIG. 5 is a sectional view showing the side of the sensor drive unit in FIG. 4.
Figure 6:
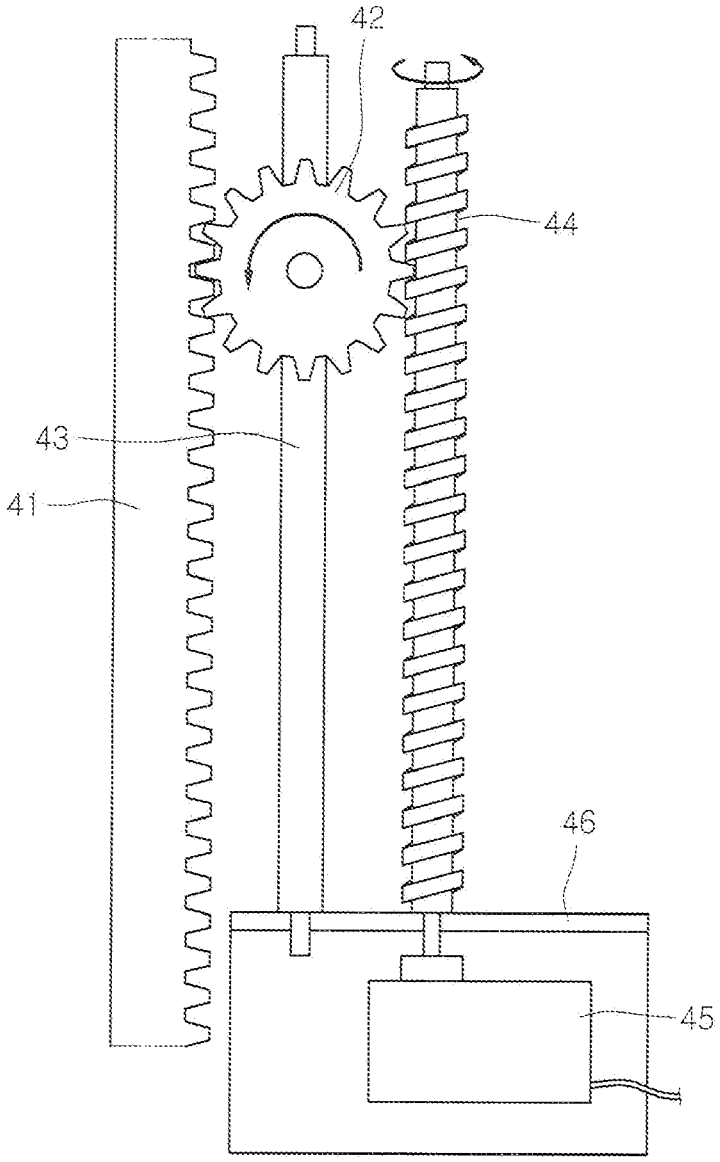
FIG. 6 is a sectional view showing the front of the sensor drive unit in FIG. 4.

FIG. 4 is an exploded perspective view showing the structure of a sensor drive unit according to embodiments of the present invention, FIG. 5 is a sectional view showing the side of the sensor drive unit in FIG. 4, and FIG. 6 is a sectional view showing the front of the sensor drive unit in FIG. 4.

Referring to FIGS. 4 to 6, a sensor drive unit according to embodiments of the present invention is mounted inside the door 12, and the inside of the door defines a receiving space for receiving the sensor drive unit.

The configuration described below is not dedicated solely to one embodiment for enabling upward and downward movement of a sensor, and is not limited to embodiments presented by the scope of rights of the present invention. In other words, various types of driving members and configurations may be proposed for moving the sensor upward and downward, and the subject matter addressed by the present invention is the ability to vertically move a sensor in a dispenser assembly of a refrigerator door.

In detail, the sensor 20 may be disposed inside the door 12 behind a slot 26, and the sensor 20 may be fixed and mounted on a support 33. Here, there is no requirement that the sensor 20 must be fixed on the same structure as the support 33. In further detail, the sensor 20 may be a remote electrostatic capacitance sensor that senses the presence or absence of matter at a sensed surface or matter in proximity through using changes in electrostatic capacitance. The remote electrostatic capacitance sensor is a sensor that detects changes in electrostatic capacitance according to movement and separation of electrical charge within matter to determine whether matter is present, and can sense, without direct contact, not only insulators such as plastic glass, ceramic, and wood, but also liquids such as water, oil, and chemicals. Accordingly, the sensor 30 can sense, without physical contact, the height of vessels made of insulating materials, and the level of water filled in such a vessel.

Also, the wire 31 may extend from the sensor 30 along the inside or surface of the supporter 33 and be connected to the PCB 32. Further, a flexible belt 34 is connected in a closed circuit configuration at the top end or bottom end of the supporter 33, so that the slot 26 can be sealed when the sensor 30 moves. Additionally, the belt 34 is supported by one or more of an idle roller 37, so that the belt 34 can maintain a uniformly-shaped curve (an elliptical curve, for example) when the sensor 30 is elevated and lowered. Moreover, by mounting the belt 34 at the rear of the slot 26, infiltration of water into the slot 26 during dispensing of water can be prevented. Accordingly, the sensor drive unit can be protected from electrical malfunctioning or fire from infiltrating water.

Further, in order to insert either side end of the supporter 33 in the door 12, a guide rib 40 may be provided to allow the sensor 30 to be moved upward and downward reliably. Here, as a member for guiding the vertical movement of the sensor 30, another member instead of the guide rib 40 may be provided.

A shaft 35 extends a predetermined length at the rear of the supporter 33, and a pinion 42 or gear is installed on the shaft 35. Also, a holder 36 such as that shown may extend from the end of the shaft 35. In detail, a hole may be defined in the end of the holder 36, and a guide bar 43 may be inserted in the hole. The guide bar 43 is vertically erected to enable the holder 36 to move along the guide bar 43 when the pinion 42 rotates and moves vertically. Thus, the movement of the sensor 30 is doubly guided so that the sensor 30 can more reliably move.

A guide rack 41 is vertically installed on a side of the pinion 42, and the pinion 42 is engaged through gears to the guide rack 41. Also, an elevating gear 44 in the shape of a worm gear of a predetermined length may be vertically installed at the other side of the pinion 42. The pinion 42 is also engaged through gears to the elevating gear 44. Further, a bracket 46 is installed at the bottom of the elevating gear 44 and the guide bar 43, so that the worm gear 44 and the guide bar 43 can be maintained in an upright state. Also, an elevating motor 45 may be connected at the undersurface of the bracket 46 to drive the elevating gear 44.

Below, a description on the operation of the sensor drive unit configured as above will be provided.

First, when a user places a vessel such as a water cup on the tray 22 of the assembly 20 and inputs a desired water level and water dispensing command, the elevating motor 45 operates. Then, the worm gear-shaped elevating gear 44 is rotated, and the pinion 42 engaged to the elevating gear 44 is rotated. Then, the pinion 42 moves along the guide rack 41. Then, the supporter 33 is moved vertically while supported by the guide rib 40, and the holder 36 moves together vertically along the guide bar 43. Accordingly, the sensor 30 can be moved vertically without wobbling. Also, the sensor 30 senses the position of the top of the vessel while moving, and with the sensed results, the controller of the refrigerator calculates the height of the vessel. Further, the sensor 30 moves to a height corresponding to the water level (½ or ⅔ the height of the cup, for example) input by the user. Then, water is supplied, and the sensor senses when the water level reaches the set height and turns off the supply of water.

A detailed description will be provided below with reference to the flowchart on a mechanism for moving a sensor and a method of supplying water, when a user inputs a water level and a water dispensing command in the refrigerator having the above-described sensor drive unit mounted.

Figure 7:
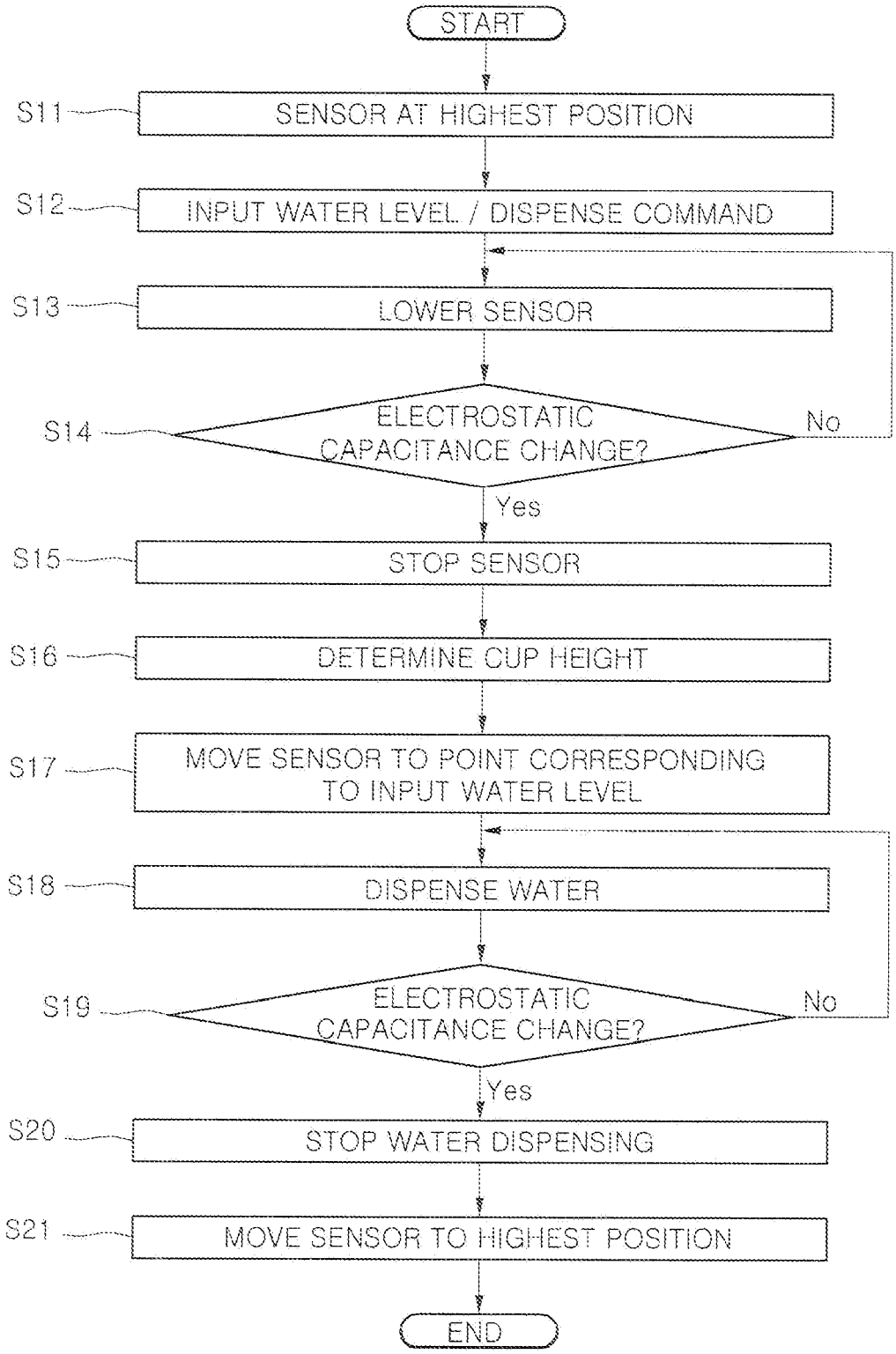
FIG. 7 is a flowchart showing an operating method of a sensor drive unit according to embodiments of the present invention.

FIG. 7 is a flowchart showing an operating method of a sensor drive unit according to embodiments of the present invention.

Referring to FIG. 7, when not operating, the sensor's default position will be designated as at the top of the slot 26 in operation S11.

In this state, after placing a vessel on the tray 22, a user inputs a desired water level and water dispensing command in operation S12. Here, the water level input and the water dispensing command may be separately input or may be simultaneously input. For example, when a user presses a button corresponding to a desired water level, water dispensing may be activated, or the water level input button and the water dispensing button may be separated provided so that two manipulations are performed.

When the above water level and water dispensing command are input, the sensor 30 begins descending in operation S13. Also, while the sensor 30 descends, it senses changes in electrostatic capacitance in operation S14, and when an electrostatic capacitance change is sensed, the sensor 30 stops in operation S15. Then, the controller receives the sensed signal and calculates in operation S16 the height at which the electrostatic capacitance has changed. That is, the calculated height is the height of the vessel. Then, using the calculated data on the height of the cup, a point corresponding to the water level input by the user is calculated. Then, the sensor 30 moves in operation S17 to the point corresponding to the water level. When the sensor 30 moves to the point corresponding to the input water level, water dispensing is begun in operation S18, and the sensor 30 senses whether there is a change in electrostatic capacitance. While water is being dispensed, the sensor 30 senses whether there is a change in electrostatic capacitance in operation S19, and transmits a sensed signal to the controller, and the controller outputs a signal to stop dispensing water so that water dispensing is ceased in operation S20. Then, the sensor 30 moves to the top of the slot 26 (or its original position) in operation S21.

Through the above configuration, the height of a vessel and water level can both be sensed by a single sensor.

What is claimed is:

1. A refrigerator comprising:

a body having a door; and a dispensing unit provided in one of the body and the door, the dispensing unit including:

a recess configured to receive a vessel;

a sensor movable upwardly and downwardly with respect to the recess; and an outlet for dispensing liquid into the vessel, the sensor being configured to detect a height of the vessel received in the recess and to detect when the dispensed liquid reaches a predetermined height.

2. The refrigerator of claim 1, wherein the dispensing unit is located in the door.

3. The refrigerator of claim 1, wherein the recess includes a slot formed therein, the sensor being moveable along the slot to detect the height of the vessel.

4. The refrigerator of claim 1, wherein the sensor is an electrostatic capacitance sensor.

5. The refrigerator of claim 1, further comprising an input unit including a plurality of inputs for selecting a desired amount of liquid to be dispensed, each of the plurality of inputs relating the amount of liquid to be dispensed to the height of the vessel.

6. The refrigerator of claim 5, wherein at least one of the plurality of inputs provides the predetermined height as being half the height of the vessel detected by the sensor.

7. The refrigerator of claim 1, wherein the dispensing unit includes a printed circuit board and a wire connecting the printed circuit board to the sensor.

8. The refrigerator of claim 7, wherein the sensor is located on a supporter moveable upwardly and downwardly, and the supporter is connected to a displacement mechanism to raise and lower the supporter.

9. The refrigerator of claim 8, wherein the displacement mechanism includes:

a rack arranged in a generally vertical direction; and a pinion engaged to the rack.

10. The refrigerator of claim 9, wherein the supporter is connected to the pinion by a shaft.

11. The refrigerator of claim 9, wherein the displacement mechanism includes:

a motor having a shaft; and a worm gear on the shaft, the worm gear being engaged with the pinion.

12. The refrigerator of claim 7, wherein the printed circuit board includes a controller, the controller being configured to control the movement of the sensor.

13. The refrigerator of claim 12, wherein the controller is configured to control the movement of the sensor from an upper position downward until the vessel is detected.

14. The refrigerator of claim 13, wherein the controller is configured to control the movement of the sensor to move the sensor to the predetermined height, to control the dispenser to dispense liquid until the sensor detects the liquid at the predetermined height, and to control the dispenser to stop dispensing of the liquid after the liquid reaches the predetermined height.

15. A method of dispensing liquid from a dispenser in a refrigerator, the dispenser including a recess for receiving a vessel, a movable sensor, and an outlet for dispensing the liquid, the method comprising:

detecting the height of the vessel placed in the recess by moving the sensor;

dispensing the liquid into the vessel;

detecting when the liquid reaches a predetermined height by the sensor; and stopping dispensing the liquid when the liquid reaches the predetermined level.

16. The method of claim 15, wherein detecting the height of the vessel includes moving the sensor from an upper position downward until a top of the vessel is detected.

17. The method of claim 16, wherein dispensing the liquid includes first moving the sensor to the predetermined height, then dispensing the liquid until the liquid reaches the predetermined height.

18. The method of claim 15, wherein the sensor is an electrostatic capacitance sensor, and wherein detecting the height of the vessel and detecting when the liquid reaches the predetermined height are indicated by changes in capacitance measured by the sensor.

19. The method of claim 15, wherein the refrigerator includes an input portion having a plurality of inputs for selecting a desired amount of liquid to be dispensed, each of the plurality of inputs relating the amount of liquid to be dispensed to the height of the vessel, the method further comprising:

detecting selection of one input of the plurality of inputs by a user; and calculating the predetermined height based on the detected input and the detected height of the vessel.

* * * * *